US006041720A

United States Patent [19]

Hardy

[11] Patent Number: 6,041,720

[45] Date of Patent: Mar. 28, 2000

[54] PRODUCT MANAGEMENT DISPLAY SYSTEM

[75] Inventor: Stephen N. Hardy, Wadsworth, Ohio

[73] Assignee: RTC Industries, Inc., Rolling Meadows, Ill.

[21] Appl. No.: 08/969,974

[22] Filed: Nov. 13, 1997

[51] Int. Cl.[7] ..... A47B 57/00

[52] U.S. Cl. ..... 108/60; 211/184

[58] Field of Search ..... 108/60, 61; 211/184, 211/183, 59.3, 43, 11

[56] References Cited

U.S. PATENT DOCUMENTS

| | | | |
|---|---|---|---|
| 3,285,429 | 11/1966 | Propst | 211/184 |
| 3,815,519 | 6/1974 | Meyer | 108/61 |
| 3,830,169 | 8/1974 | Madey | 108/61 |
| 4,482,066 | 11/1984 | Dykstra . | |
| 4,830,201 | 5/1989 | Breslow | 211/184 |
| 4,934,645 | 6/1990 | Breslow . | |
| 5,366,099 | 11/1994 | Schmid | 211/184 X |
| 5,390,802 | 2/1995 | Pappagallo et al. . | |
| 5,464,105 | 11/1995 | Mandeltort | 108/61 X |
| 5,469,976 | 11/1995 | Burchell | 211/184 X |
| 5,673,801 | 10/1997 | Markson | 211/184 X |
| 5,738,019 | 4/1998 | Parker | 108/61 X |

FOREIGN PATENT DOCUMENTS

| | | | |
|---|---|---|---|
| 0398500 | 11/1990 | European Pat. Off. | A47F 3/14 |
| 0454586 | 10/1991 | European Pat. Off. | A47F 1/12 |
| 0779047 | 11/1996 | European Pat. Off. . | |
| 2027339 | 2/1980 | United Kingdom | A47F 1/12 |
| 2283407 | 10/1994 | United Kingdom . | |

*Primary Examiner*—Jose V. Chen
*Attorney, Agent, or Firm*—Banner & Witcoff, Ltd.

[57] ABSTRACT

A system for organizing and displaying items on a gondola shelf system comprising a gondola shelf connected to at least one vertical upright, the shelf including a front and a rear portion, a rail extending along and affixed to the front portion of the shelf, the rail comprising, a rail shelf surface extending longitudinally along the front portion of the shelf, the rail shelf surface including a first tongue extending from the rail shelf surface; a rail groove surface extending substantially perpendicular from the rail shelf surface, the rail groove surface including a first groove extending along the groove surface; and a display apparatus slidably engaged with the front rail, the display apparatus comprising a second tongue and a second groove, the first tongue engaging the first groove and the second tongue engaging the second groove.

12 Claims, 3 Drawing Sheets

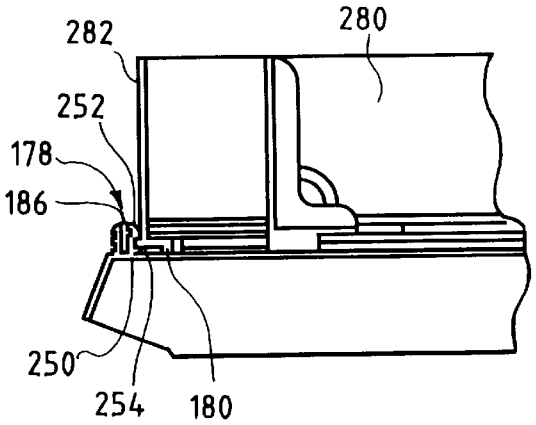
FIG. 3
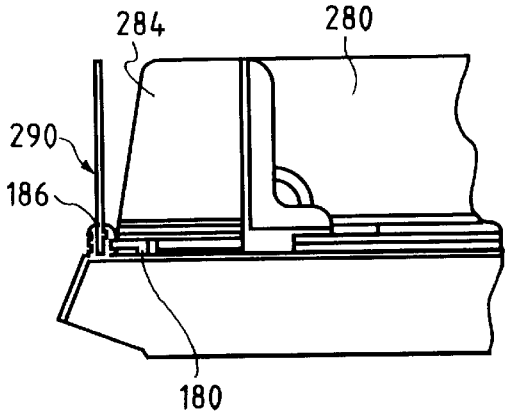
FIG. 4
FIG. 5
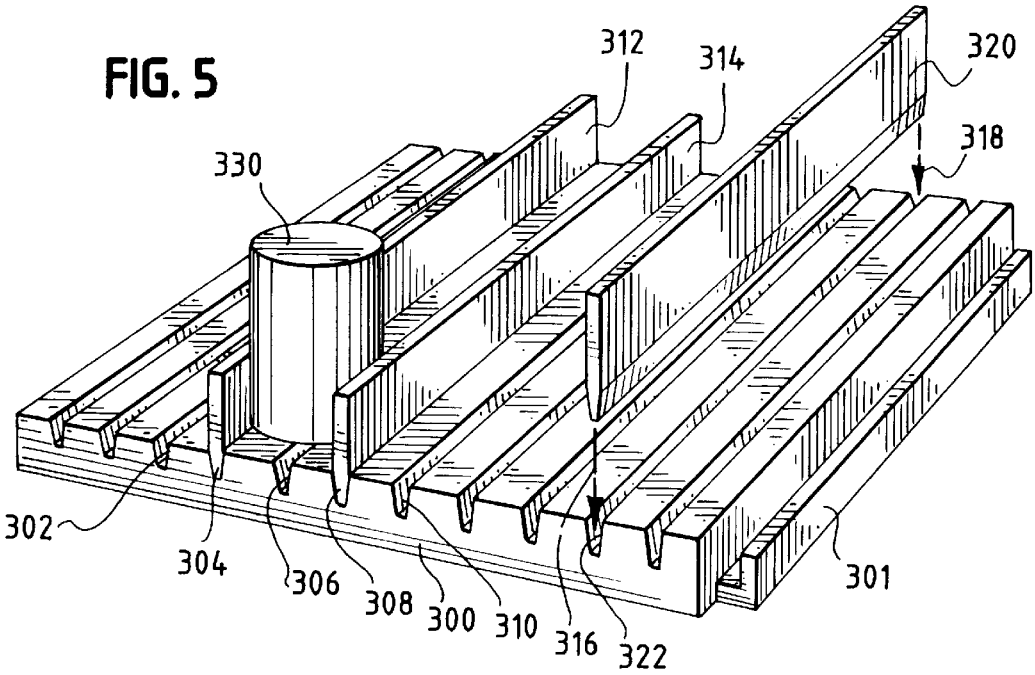

PRODUCT MANAGEMENT DISPLAY SYSTEM

FIELD OF THE INVENTION

The present invention relates generally to a shelf assembly for use in merchandising display stands including a pair of vertically slotted spaced uprights or standards. More specifically, the invention is directed to improved mechanisms for displaying, pushing and dividing merchandise on the shelves.

BACKGROUND OF THE INVENTION

Retail store locations, such as drug stores, grocery stores and toy stores, require a large amount of shelving both to store merchandise and to display the merchandise to consumers. The shelving should be inexpensive, easy to install and capable of organizing and displaying a large number of items. To satisfy these requirements, many retail store locations use gondola shelving systems. Gondola shelving systems typically employ long metal gondola shelves attached to slotted gondola uprights. These systems can be quickly and inexpensively assembled and are widely used in retail store locations. Further details of prior art shelving systems are explained in U.S. Pat. No. 4,934,645, "Shelving Assembly," and U.S. patent application Ser. No. 08/596,301 "Adjustable Shelf Assembly For Merchandising Display Stand," which are expressly incorporated in this application by reference.

It is desirable that merchandise on the shelves be situated toward the front of the shelf so that the merchandise is visible and accessible to consumers. Thus, as merchandise is removed from a shelf, it is advantageous to push the remaining merchandise toward the front of the shelf. It is also desirable to include dividing panels or dividers to separate merchandise on a display shelf.

Prior art gondola shelving systems have employed pushing devices or dividers to push merchandise toward the front of a display shelf or divide the merchandise. The pushing devices or dividers are coupled to the shelf so that the pushing devices or dividers do not twist, bend or fall off the shelf. The pushing devices or dividers may be coupled to the shelf by a tongue near the front of the pushing device that engages a groove in a rail near the front of the shelf.

However, this arrangement is sometimes unsatisfactory. If the tongue is located on the underside of the pushing device or divider, the pushing device or divider may rotate back-to-front or tip sideways, in other words rock side to side. If the tongue and groove relationship is located on a front surface of the pushing device or divider, the pushing device or divider may still rotate back-to-front or rotate so that it is no longer perpendicular to the front of the shelf.

One prior art approach to these problems involves fastening the rear of the sliding device or divider to the rear of the shelf with a bolt or similar fastening device. This approach requires that appropriate holes be located near the rear of the shelf. In addition, this approach prevents the pushing apparatus or divider from sliding laterally along the shelf. Thus, if the spacing between the pusher device or divider needs to be adjusted, for example to display merchandise of a different size, a user must detach the bolt, slide the pusher device or divider to a new location, and then reattach the bolt. Such a labor intensive operation is not preferred in a retail store location.

Another prior art approach to this problem involves including a second grooved rail, parallel to the first grooved rail, near the back of the shelf. This approach is undesirable because if a pushing device or divider on two parallel grooves is pushed laterally with only one hand, it may bind or get jammed, in other words, becomes sufficiently misaligned such that it will no longer slide until it is straightened.

Thus, an object of the present invention is an improved pusher/divider system for use with existing gondola systems. An additional object of the invention is a low cost pushing and dividing apparatus. Another object of the invention is a unitary apparatus for pushing and dividing merchandise. An additional object of the invention is a pushing apparatus that is more readily mounted to a shelving system.

SUMMARY OF THE INVENTION

In a preferred embodiment of the invention, a system for organizing and displaying items on a gondola shelf system comprises a gondola shelf connected to at least one vertical upright. The shelf including a front and a rear portion. A preferred embodiment of the invention further comprises a rail extending along and affixed to the front portion of the shelf. The rail comprises a rail shelf surface extending longitudinally along the front portion of the shelf. The rail shelf surface includes a first tongue extending from the rail shelf surface and a rail groove surface extending substantially perpendicular from the rail shelf surface. The rail groove surface includes a first groove extending along the groove surface. A preferred embodiment further comprises a display apparatus slidably engaged with the front rail, the display apparatus comprising a second tongue and a second groove. The first tongue engages the second groove and the second tongue engages the first groove.

In another preferred embodiment of the invention, a display system for an existing gondola shelf system comprises a first interlocking panel including a first locking tab and a first plurality of wedge-shaped grooves. This preferred embodiment further includes a second interlocking panel. The first and the second interlocking panels form a floor resting on a gondola shelf or frame. The second interlocking panel comprises a first receiving recess engaged with the first locking tab and a second plurality of wedge-shaped grooves. The preferred embodiment further includes a plurality of display components, each of the display component including a wedge-shaped tip engaging one of the first or second plurality of wedge-shaped grooves.

BRIEF DESCRIPTION OF THE DRAWINGS

Preferred embodiments of the present invention are described with reference to the following figures:

FIG. 3 is a side elevational view of a shelf assembly including a pusher device.

FIG. 4 is a side elevational view of a shelf assembly including a pusher device and an end panel.

FIG. 5 is a overhead oblique view of an alternative preferred embodiment of a component system.

DETAILED DESCRIPTION OF THE PREFERRED EMBODIMENTS

Figures 1, 2:
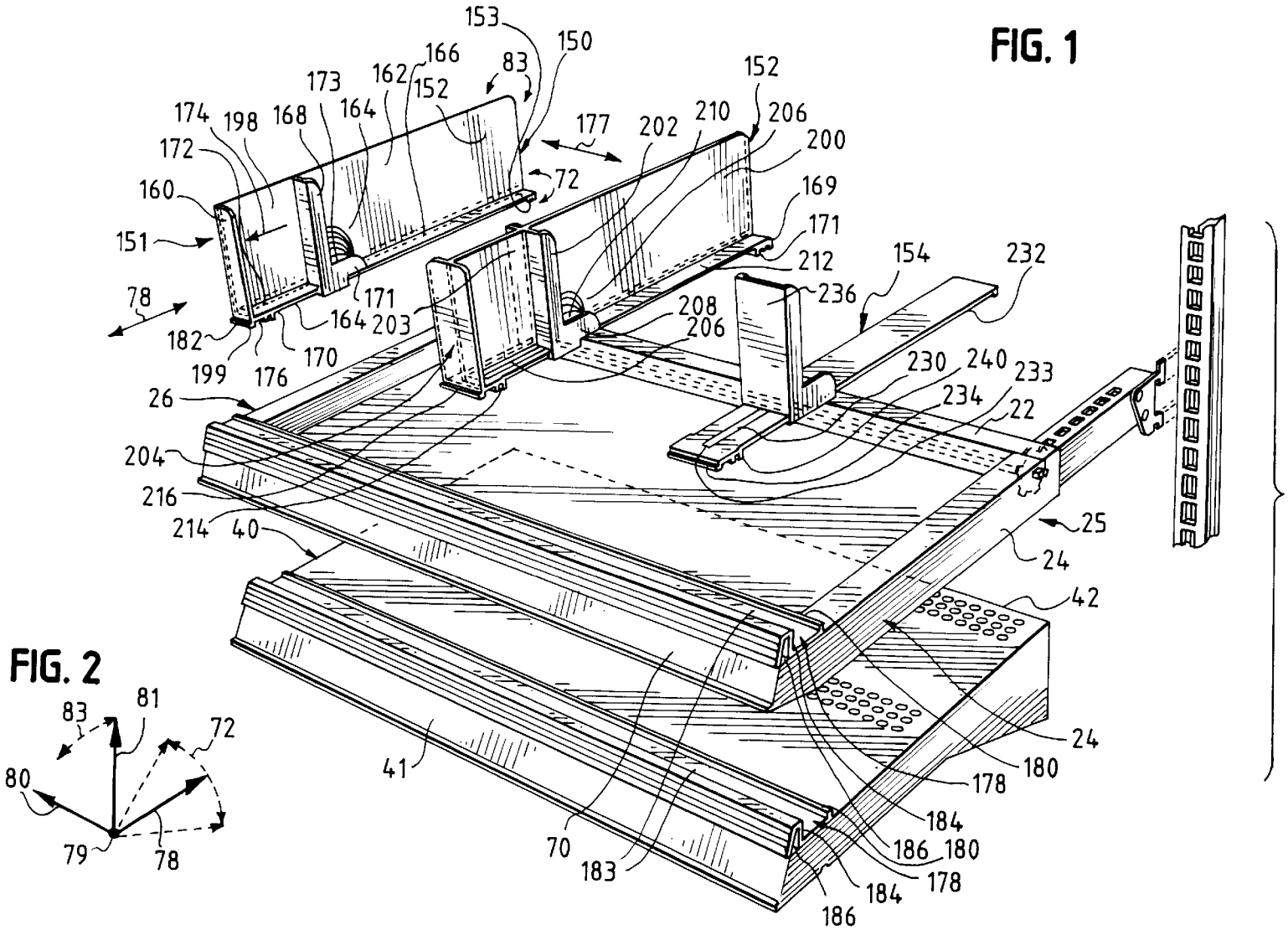
FIG. 1 is a front oblique view of a preferred embodiment of the present invention with two different shelving structures.
FIG. 2 is a three dimensional depiction of axes of rotation relating to the present invention.

Referring to FIG. 1, a preferred embodiment of the invention may be employed with various shelf structures, such as a shelf frame 25 or a standard dealer shelf 40. The shelf frame 25 includes a back cross rail 22, a side rail 24, a side rail 26 and a front cross rail 70. A gondola bracket 28 connects to a slotted upright or standard (not shown). Specifically, tabs 32 and 34 are fitted into slots in the upright. The upright is typically attached to a back wall. Similarly, the dealer shelf 40 includes a gondola bracket (not shown) to attach the shelf 40 to a slotted upright (not shown). The dealer shelf 30 includes a front portion 41 and a rear portion 42.

Referring to the shelf frame 25, affixed to the front rail 70 is a display rail 178. Similarly, affixed to the front portion 41 of the dealer shelf 40 is the display rail 178. The display rail 178 includes rail shelf surface 183 and a rail groove surface 184. The groove surface 184 includes a groove, which is not shown in FIG. 1, that extends the length of the display rail 178. The display rail 178 also includes a ridge or tongue 180 that extends along the length of the display rail 178. The display rail 178 further includes a groove 186 in which a clear plastic panel (not shown) that runs the length of the display rail 178 may be inserted.

The invention may include one or more of a variety of merchandise displays, for example, a pusher-end device 150, a pusher-divider 152 or a pusher 154 to organize merchandise and/or force it toward the front of the display.

The pusher-end device 150 is a left hand divider that includes a clear panel 160, a side panel 162, a resilient metal ribbon strip 164, a base panel 166 and a sliding apparatus or pusher 168. The panel 160 and panel 162 controls the location of merchandise.

An edge 170 of the metal ribbon strip 164 is attached to the base panel 166 via a recess 172 in the base 166. The metal ribbon strip is coiled and held by two parallel panels 171, 173 in the sliding apparatus or pusher 168. The metal ribbon strip 164 pulls the sliding apparatus in the direction of the arrow 174. As merchandise (not shown) is removed from the display, the sliding apparatus slides the remaining merchandise toward the front of the shelf assembly 20 and the panel 160. The pusher-end device 150 includes a front portion 151 and a rear or back portion 159. The area between the pusher 168 and the panel 160 defines a merchandise display surface 198. The meeting of the panel 160 and the base 166 defines a front surface 199.

The base 166 of the pusher-end device 150 includes a groove 176 for engaging the tongue 180 of the display rail 178. The base 166 also includes a ridge or tongue 182 extending from the base 166 for engaging the groove (not shown in FIG. 1) in the surface 184 of the display rail 178. The base 166 includes an underside 197 along which edges of the groove 176 extend.

The pusher end device 150 is inserted into the rail 178 in the following manner. First, the pusher end device 150 is held over the rail 178, and the front portion 151 of the pusher end device is angled toward the rail 178. The tongue 182 is inserted into the groove 250 (not shown in FIG. 1). Next, the back portion 159 of the pusher end device 150 is rotated toward the rail 178 so that the tongue 180 engages the groove 176. Once inserted, a rear lip 153 slides along the rail 22 or the shelf 40 as the pusher end device 150 is moved laterally in the direction indicated by the arrow 177. However, so long as the pusher end device, particularly the base 166, is made of a stiff material, it is not necessary for the rear lip 153 to rest on another surface. Other display devices 152, 154 are similarly inserted into the rail 178.

Referring to FIG. 1 and FIG. 2, the length of the pusher end device 150 define an axis 78. The length of the groove 176 defines another axis 80, which together with the axis indicated by the arrow 78, forms a first plane. The complementary tongue and groove cooperation of the invention prevents the pusher end device 150 from rotating, as indicated by the direction shown by the arrow 72, about a point 79 in first plane.

The vertical height of the pusher end device 150 defines another axis 81. The axis 81 and the axis 80 form a second plane. The complementary tongue and groove cooperation of the invention also prevents the pusher end device 150 from rocking or tipping, as indicated by the arrow 83, about the point 79 in the second plane.

The invention still allows the pusher-end device 150 to be readily moved laterally in the direction of the arrow 177 in FIG. 1. Similarly, the pusher divider 152 and pusher 154 are affixed to the rail 178 by the tongue 180 in the groves 214 and 240 respectively, and the tongues 216, 234, respectively, in the groove 250.

Similar to the pusher-end device 150, the pusher-divider 152 includes a divider panel 200, a pusher 202 and a clear end panel 204. The divider panel 200 is preferably made of clear plastic material. The pusher 202 is forced toward the front of the display system by a flexible metal strip 206 that is coiled by two parallel panels 208, 210 in the pusher 202 and is connected to a base portion 212 of the pusher-divider 208. A groove 214 in the base 212 engages the tongue 180 in the rail 178, and a tongue or ridge 216 engages a groove (not shown) in the rail 178. Similarly, a second pusher 203, shown in dotted lines, is on the opposite side of the panel 200 from the pusher 202.

The pusher divider 152 further includes a tongue 169 and a groove 171 at the opposite end of the tongue 216 and the groove 214. Thus, the pusher divider 152 is reversible, and may be inserted in the rail 178 in a direction opposite that shown in FIG. 1.

The pusher 154 includes resilient metal ribbon strip 230 that is affixed to a panel 232 at a recess 233. The metal strip 230 is coiled (not shown) as are the metal strips 164, 206, and directs a pusher 236 toward the front of the display unit. A groove 240 in the base 232 engages the tongue 180 in the rail 178, and a tongue or ridge 234 engages a groove (not shown) in the rail 178.

As would be understood by one skilled in the art, in another preferred embodiment of the invention, a universal base, such as base 212 or 232, serves to support one of a variety of components. For example, the base 212 or 232 may support a pusher track with or without a pusher, or with or without a divider panel. Furthermore, a divider panel could be attached on either side of the base 212 or 232.

Further details of the rail 178 are evident from FIG. 3 and FIG. 4. The tongue 180 engages the grooves 176, 214 and 240 of the pusher-end device 150, the pusher-divider 152, and the pusher 154, respectively. Similarly, a groove 250 is formed by an edge 252 and an edge 254 of the rail 178. The groove 250 engages the tongues 182, 216 and 234 of the pusher end device 150, the pusher-divider 152, and the pusher 154, respectively.

Referring still to FIGS. 3 and 4, a plastic divider 280 includes a square edge 282 and a rounded edge 284. The square edge 282 extends laterally along the front of the device in the direction of the tongue 180. The divider 280 may be positioned so that the square edge 282 faces the front portion 41 of the shelf 40, as in FIG. 3. The divider 280 may also be positioned such that the rounded edge 284 of the divider is positioned to face the front portion 41 of the shelf 40, as in FIG. 4. In such a configuration, a plastic panel or front retainer 290, as is shown in FIG. 4, may be employed. With this arrangement, merchandise in the display system is retained by the additional panel 290.

An alternative display configuration for use with existing shelf systems is shown in FIG. 5. An interlocking floor panel 300, which is injection molded, includes a plurality of pockets or grooves 302, 304, 306, 308, 310. The floor panel 300 additionally includes a locking tab 301. Divider panels 312, 314 are wedged into the grooves 304, 308 respectively to separate merchandise. A panel 320 is inserted into a groove 322 by pushing the panel 320 into the groove 320 as indicated by the arrows 316, 318. A product 330 is situated between the dividers 312 and 314.

Figure 6:
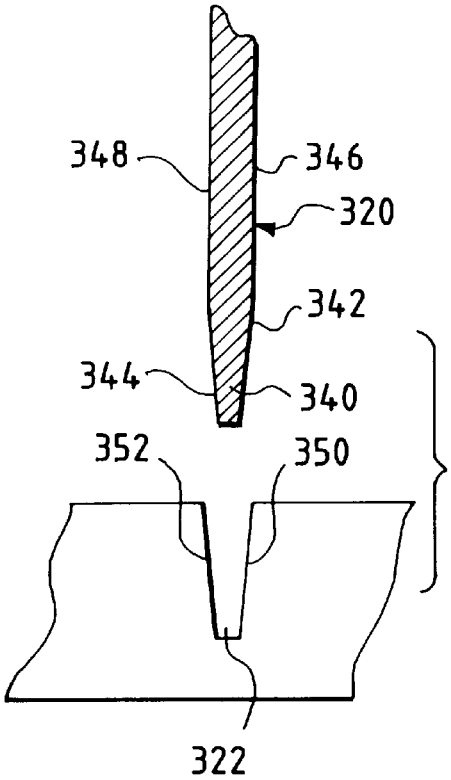
FIG. 6 is a side elevational view of a portion of the component system of FIG. 5.

Referring to FIG. 6, the divider panel 320 includes a tip 340, edges 346, 348, and tip edges 342, 344. A draft angle or taper, preferably about two degrees, is cut on the tip edges 342, 344 relative to the edges 346, 348, respectively. A similar draft angle or taper is made on walls 350, 352 of the groove 322.

Figure 7:
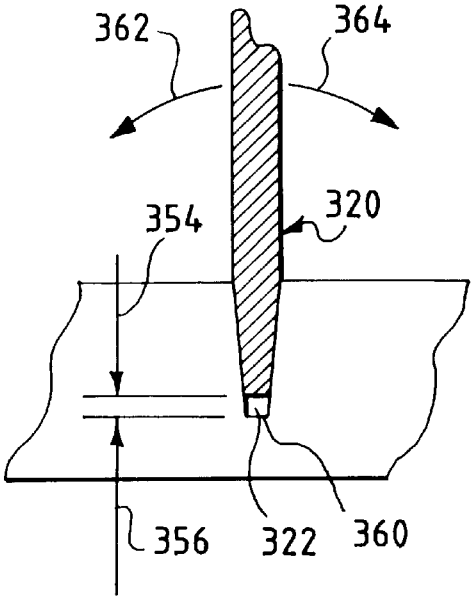
FIG. 7 is a side elevational view as in FIG. 6.

As is shown at arrows 354, 356 in FIG. 7, the groove 322 is cut such that wedging of the panel 320 occurs before the tip 340 of the panel touches a bottom edge 360 of the groove 320. The panel 342 is sufficiently wedged in the groove 322 such that it does not bend or sway in the directions indicated by arrows 362, 364.

Figure 8:
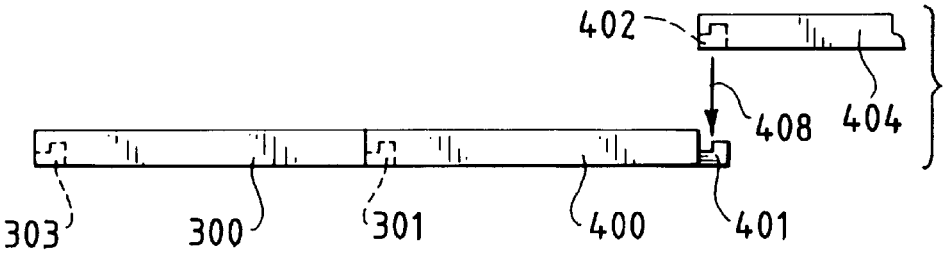
FIG. 8 is a side elevational view of interlocking floor panels of FIG. 5.

Referring to FIG. 8, the floor panel 300 includes a recess 303 for receiving a locking tab. A locking tab 301 of the floor panel 300 engages a recess in a floor panel 400, which includes a locking tab 401 that engages a recess 402 in a floor panel 404, as indicated by arrow 408. Thus, interlocking floor panels 300, 400, 404 form a floor that is situated on a shelf, such as shelf 40 in FIG. 1, or a shelf frame, such as shelf frame 25 in FIG. 1.

As described, the interlocking floor becomes a base for building and adding a variety of display devices for dividing and pushing merchandise. These display devices may include dividers, as described, and may also similarly include pushers, two tier tracks or other components.

It is to be understood that alternative forms of the various components of the described embodiments are covered by the claimed invention and its equivalents. For example, although this description is directed to particular pusher and divider devices, the invention is not limited to the examples shown in this description. To particularly point out and distinctly claim the subjects regarded as the invention, the following claims conclude this specification.

I claim:

1. A system for organizing and displaying items on a gondola shelf system comprising:

a gondola shelf connected to at least one vertical upright, the shelf including a front and a rear portion;

a rail extending along and affixed to the front portion of the shelf, the rail comprising:

a rail shelf surface extending longitudinally along and substantially parallel to the top of the front portion of the shelf, the rail shelf surface including a first tongue extending substantially perpendicular from the rail shelf surface;

a rail groove surface extending substantially perpendicular from the rail shelf surface, the rail groove surface including a first groove extending along the groove surface and substantially parallel to the rail shelf surface; and a display apparatus slidably engaged with the front rail, the display apparatus comprising a second tongue and a second groove separate from the second tongue, the first tongue engaging the second groove and the second tongue engaging the first groove.

2. A system as in claim 1 wherein the display apparatus comprises a base, a pusher for pushing merchandise toward the front rail and a side panel.

3. A system as in claim 1 wherein the display apparatus comprises a universal base capable of coupling to a divider such that the divider is positioned substantially parallel to a longitudinal axis of the display apparatus.

4. A system as in claim 1 wherein the display apparatus includes a divider panel, a first to pusher and a second pusher, the first and second pushers independently pushing merchandise toward the front rail.

5. A merchandise display apparatus slidably engaged in a single front rail extending longitudinally along a gondola shelf, the display apparatus comprising:

a merchandise display surface, a front surface and an underside surface;

a first tongue extending from the front surface, the first tongue engaging a first groove in the front rail;

a second groove extending along edges in the underside surface of the slidable display apparatus, the second groove engaging a second tongue in the front rail;

wherein the display apparatus is slidably engaged along with the front rail by complementary tongue and groove cooperation of the display apparatus and the front rail.

6. The merchandise display apparatus as in claim 5 wherein the display apparatus is coupled only to the front rail by the complementary cooperation of the display apparatus tongue and the front rail groove and of the display apparatus groove and the front rail tongue.

7. The display apparatus as in claim 6 wherein the display apparatus comprises a pushing apparatus for pushing merchandise toward the front rail.

8. The display apparatus as in claim 6 wherein the display apparatus comprises a divider panel.

9. The display apparatus as in claim 6 wherein the display apparatus comprises a unitary pushing apparatus and dividing apparatus.

10. A system as in claim 1 wherein the display apparatus comprises a universal base capable of coupling, via a resilient metal ribbon strip, to a pusher for pushing merchandise toward the front rail.

11. A system as in claim 10 wherein the universal base is capable of coupling to a divider such that the divider is positioned substantially parallel to a longitudinal axis of the display apparatus.

12. A system as in claim 1 wherein the front rail further comprises a groove adapted to receive a front retainer for retaining displayed merchandise.

* * * * *